US005784973A

United States Patent [19]

Mercer et al.

[11] Patent Number: 5,784,973

[45] Date of Patent: Jul. 28, 1998

[54] SECURE ENCLOSURE FOR AUTOMATED BANKING MACHINE

[75] Inventors: Scott A. Mercer, Hanoverton; Paul J. Cox, Louisville; Kenneth C. Kontor, Chesterland; H. Thomas Graef, Bolivar, all of Ohio

[73] Assignee: InterBold, North Canton, Ohio

[21] Appl. No.: 614,410

[22] Filed: Mar. 12, 1996

[51] Int. Cl.[6] ..... E05G 1/04; E05B 3/36

[52] U.S. Cl. ..... 109/59 R; 109/64; 109/74; 70/120; 70/103; 292/40; 292/37

[58] Field of Search ..... 109/44, 59 R, 109/60, 61, 62, 63.5, 64, 70, 69, 71, 72, 74; 70/63, 103, 168, 104, 113, 118, 120; 292/37, 32, 40

[56] References Cited

U.S. PATENT DOCUMENTS

| | | | |
|---|---|---|---|
| 1,118,303 | 3/1914 | Meyer | 70/448 |
| 1,280,993 | 10/1918 | Hammer | 70/109 |
| 1,359,347 | 11/1920 | Fleisher | 70/104 |
| 1,399,897 | 12/1921 | Singer | 292/DIG. 55 |
| 1,749,222 | 3/1930 | Merriam . | |
| 4,158,337 | 6/1979 | Bahry et al. | 109/64 |
| 4,228,746 | 10/1980 | Caton | 109/64 |
| 4,266,372 | 5/1981 | Taniwaki . | |
| 4,435,921 | 3/1984 | Marin | 292/40 |
| 4,520,736 | 6/1985 | Crosby et al. | 109/63.5 |
| 4,532,870 | 8/1985 | Hayman . | |
| 4,608,932 | 9/1986 | Bohland et al. . | |
| 4,640,111 | 2/1987 | Hashizume . | |
| 4,679,415 | 7/1987 | Spratt . | |
| 4,690,073 | 9/1987 | Shoop . | |
| 4,712,490 | 12/1987 | Lichter . | |
| 4,714,030 | 12/1987 | Cole | 109/59 J |
| 4,848,118 | 7/1989 | Tesone . | |
| 5,209,168 | 5/1993 | Chapron et al. . | |

*Primary Examiner*—Darnell M. Boucher
*Attorney, Agent, or Firm*—Ralph E. Jocke

[57] ABSTRACT

A secure enclosure (10) for an automated banking machine includes a door (30). A bolt (38) is slidably mounted on the door and is moveable responsive to the condition of a lock. The bolt includes front portions (56) and back portions (58). In the extended position the bolt engages a latch (60) and an angle member (52) attached to the door. In the extended position, the front portions of the bolt extend through apertures (62), (78) in the latch and angle members respectively. The back portion of the bolt engages second bolt engaging portions (80). An opposed side of the door from the latch includes projecting portions (64). The projecting portions extend in pockets (64) when the door is in the closed position.

57 Claims, 7 Drawing Sheets

SECURE ENCLOSURE FOR AUTOMATED BANKING MACHINE

TECHNICAL FIELD

The invention relates to automatic banking machines. Specifically this invention relates to a secure enclosure for use in conjunction with an automatic banking machine that holds currency bills, customer deposits or other items of value.

BACKGROUND ART

Automated banking machines are well known in the prior art. Automated banking machines include automated teller machines (ATMs). Other types of automated banking machines dispense cash, either to a bank teller or directly to a bank customer. Other types of automated banking machines accept cash, checks or other items of value from a customer.

A common feature of most types of automated banking machines is that they include a secure enclosure or chest that holds valuable items stored within the machine. The secure chest may also house critical electrical or electronic components. Enclosing the valuable and critical components within a secure chest minimizes the risk that valuables will be stolen or that the critical components will be tampered with by criminals.

While it is desirable for secure enclosures used in connection with automated banking machines to be as secure as reasonably possible, they must also be readily accessible by authorized personnel. The contents of a secure enclosure such as cash and customer deposits, must be accessible for replenishment or removal on a convenient basis to authorized personnel. Secure enclosures are typically provided with an access door, which when opened provides ready access to the interior of the secure enclosure. The access door is typically provided with a locking mechanism, such as one or more combination locks that may be readily opened by authorized personnel.

Various approaches have been taken in the prior art to providing secure enclosures for automated banking machines. The secure access doors of such enclosures have included numerous types of bolt work in an effort to minimize the risk that the secure enclosure can be opened by unauthorized personnel. Some prior art enclosures have drawbacks and deficiencies. Certain prior art enclosures have access doors which are subject to being more readily compromised than is desirable. Other designs are bulky or highly complex. Some designs suffer the drawbacks of high cost and weight. Some designs require properly authorized personnel to expend more time and energy to open the access door than would otherwise be desirable.

Thus there exists a need for an improved secure enclosure for an automated banking machine that provides enhanced security, has reduced cost and complexity and yet allows an access door to the enclosure to be readily opened by authorized personnel.

DISCLOSURE OF INVENTION

It is an object of the present invention to provide a secure enclosure for an automated banking machine.

It is a further object of the present invention to provide an apparatus for securing an access door of an enclosure within an automated banking machine.

It is a further object of the present invention to provide an apparatus for securing a door of an automated banking machine in a closed position, which apparatus may be readily released by authorized personnel.

It is a further object of the present invention to provide an apparatus for securing a door of an enclosure in an automated banking machine which includes a bolt work which is resistant to being compromised.

It is a further object of the present invention to provide an apparatus for securing a door of an enclosure in an automated banking machine which includes a deadbolt which provides enhanced resistance to being compromised.

It is a further object of the present invention to provide a method for securing a door of an enclosure in an automated banking machine.

It is a further object of the present invention to provide a method for securing a door of an automated banking machine in a closed position which provides resistance to being compromised.

Further objects of the present invention will be made apparent in the following Best Modes For Carrying Out Invention and the appended claims.

The foregoing objects are accomplished in a preferred embodiment of the invention by a secure enclosure in an automated banking machine. The enclosure has a wall bounding an interior area. The enclosure includes an opening which may be selectively opened and closed by a door. The door is mounted in a hinged manner enabling the door to move outward from a closed position to provide access to the interior area of the enclosure.

The door includes a lock thereon. The lock is manually changeable between locked and unlocked conditions from the exterior of the door. In the preferred form of the invention the lock is a combination lock that may be readily opened only by authorized persons.

A bolt is movably mounted on the interior of the door. The bolt is movable from an extended position to a retracted position responsive to unlocking of the lock. The bolt includes a plurality of vertically spaced front portions. The bolt also includes a plurality of back portions which are inwardly spaced relative to the opening from the front portions.

A latch is mounted to a first portion of the wall and extends in the interior area of the enclosure. The latch includes a first bolt engaging portion. The first bolt engaging portion includes a plurality of first apertures. Each aperture accepts a front portion of the bolt therein when the bolt is in the extended position.

The latch also includes a plurality of second bolt engaging portions which are disposed inwardly of the first bolt engaging portions. In the extended position of the bolt, the back portions of the bolt are engaged with the second bolt engaging portions of the latch.

The door further includes a projecting member. The projecting member extends in cross section intermediate of the first bolt engaging portion of the latch and the enclosure wall. The projecting member includes a plurality of first projection apertures. In the extended position of the bolt, each front portion extends into an aperture in the projecting member as well as through the latch apertures in the first bolt engaging portion of the latch. The engagement of the bolt in the extended position with the first bolt engaging portion of the latch, the projecting member of the door and the second bolt engaging portion of the latch resists movement of the door toward the open position. Efforts to deform the door or enclosure wall by criminals results in deformation which tends to bind the bolt into engagement with the latch and the door. This makes it more difficult to compromise the door and secure enclosure.

In a preferred form of the invention, the enclosure is bounded on a side opposed of the latch by a second wall portion. The door is movably mounted adjacent to the second wall portion by hinges. A side of the door adjacent the second wall portion is in connected relation with a plurality of projecting portions. The second wall portion includes a plurality of pockets that are sized for accepting the projecting portions. When the door is in the closed position, the projecting portions extend in the pockets. As a result, when the door is in the closed position, the engagement of the projecting portions in the pockets prevents outward movement. This further increases the security of the door and minimizes the risk that the enclosure may be compromised by unauthorized persons.

BEST MODES FOR CARRYING OUT INVENTION

Figure 1:
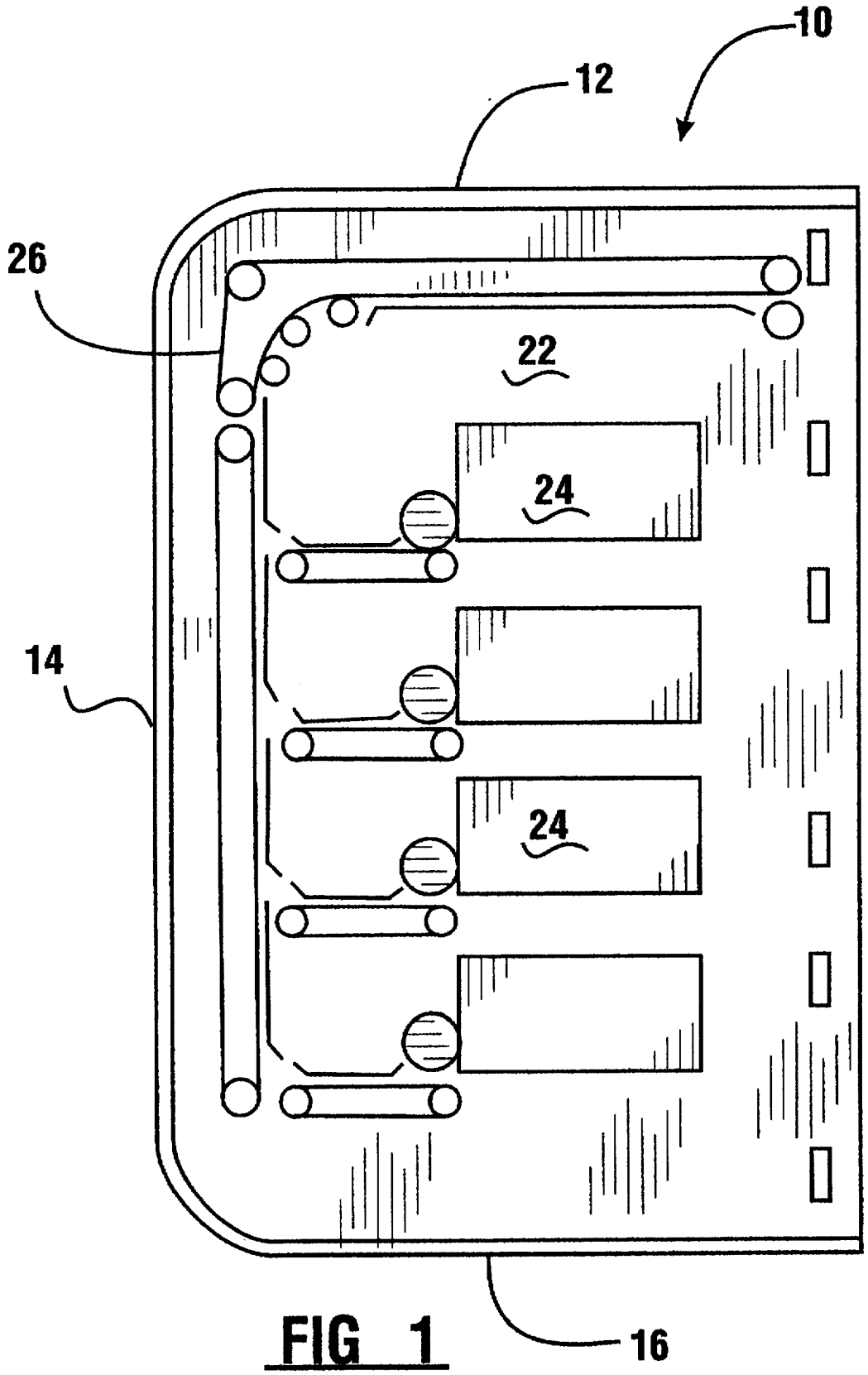
FIG. 1 is a schematic cross sectional view of a secure enclosure of an automated banking machine housing a cash delivery mechanism.

Referring now to the drawings and particularly to FIG. 1, there is shown therein a vertical cross-sectional schematic view of an enclosure for an automated banking machine, generally indicated 10. Enclosure 10 includes a top wall 12, a back wall 14 and a bottom wall 16. In the preferred form of the invention, walls 12, 14 and 16 are formed from a single sheet of heavy gage steel material.

Figure 2:
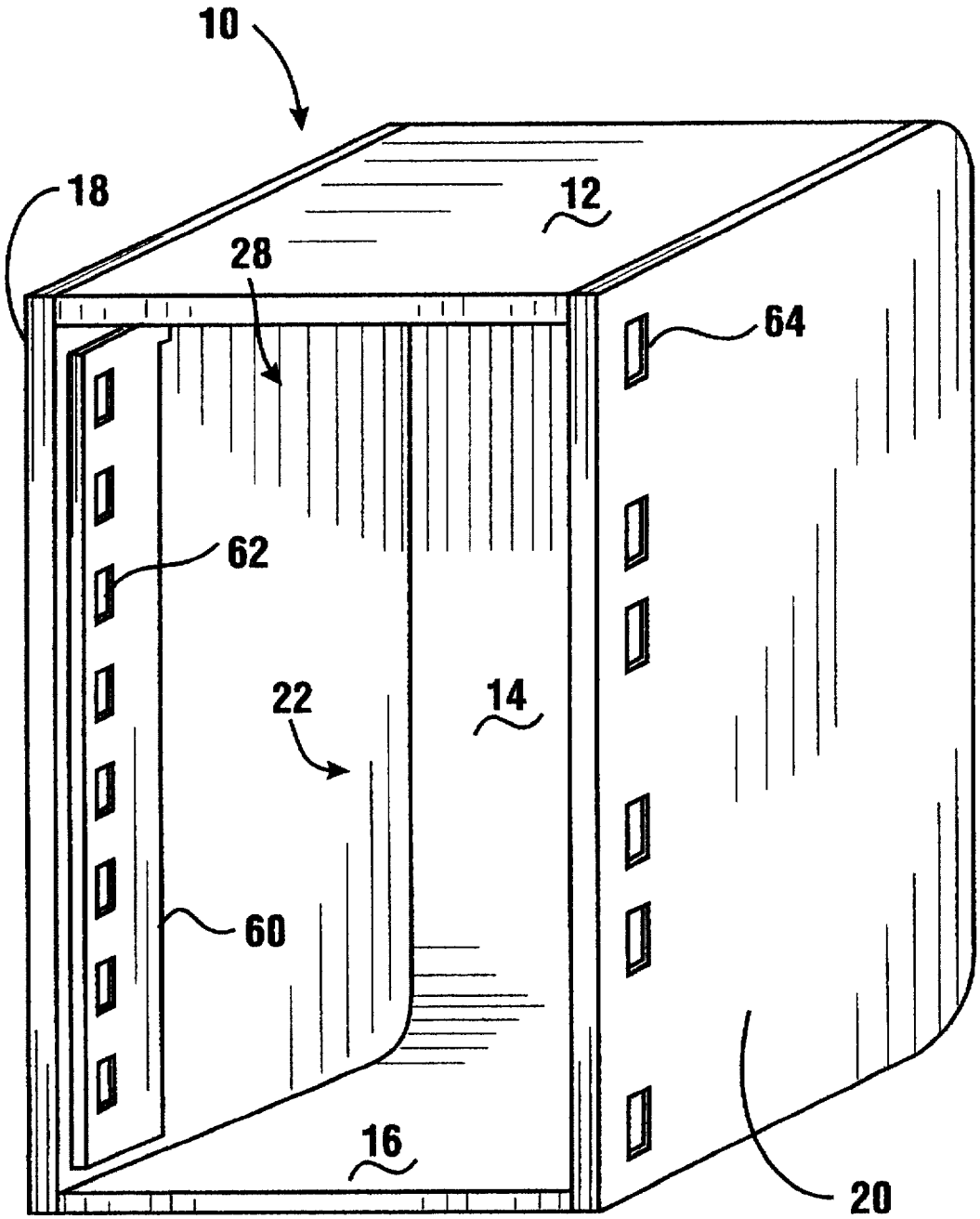
FIG. 2 is an isometric view of a secure enclosure of the present invention without its associated door.

As shown in FIG. 2, enclosure 10 further comprises a first side wall 18 and a second side wall 20. The walls of enclosure 10 bound an interior area generally indicated 22. In the preferred form of the invention, side walls 18 and 20 are secured by welding to the formed sheet which comprises the other walls.

As shown schematically in FIG. 1, interior area 22 houses a plurality of currency containers 24 and a currency transport mechanism schematically shown as 26. It should be understood that while in the embodiment shown, interior area 22 houses currency and a currency delivery mechanism, in other embodiments of the invention the interior area may house other components of an automated banking machine. These components may include electrical or electronic components of the machine as well as deposit, currency and check receiving mechanisms.

Figure 3:
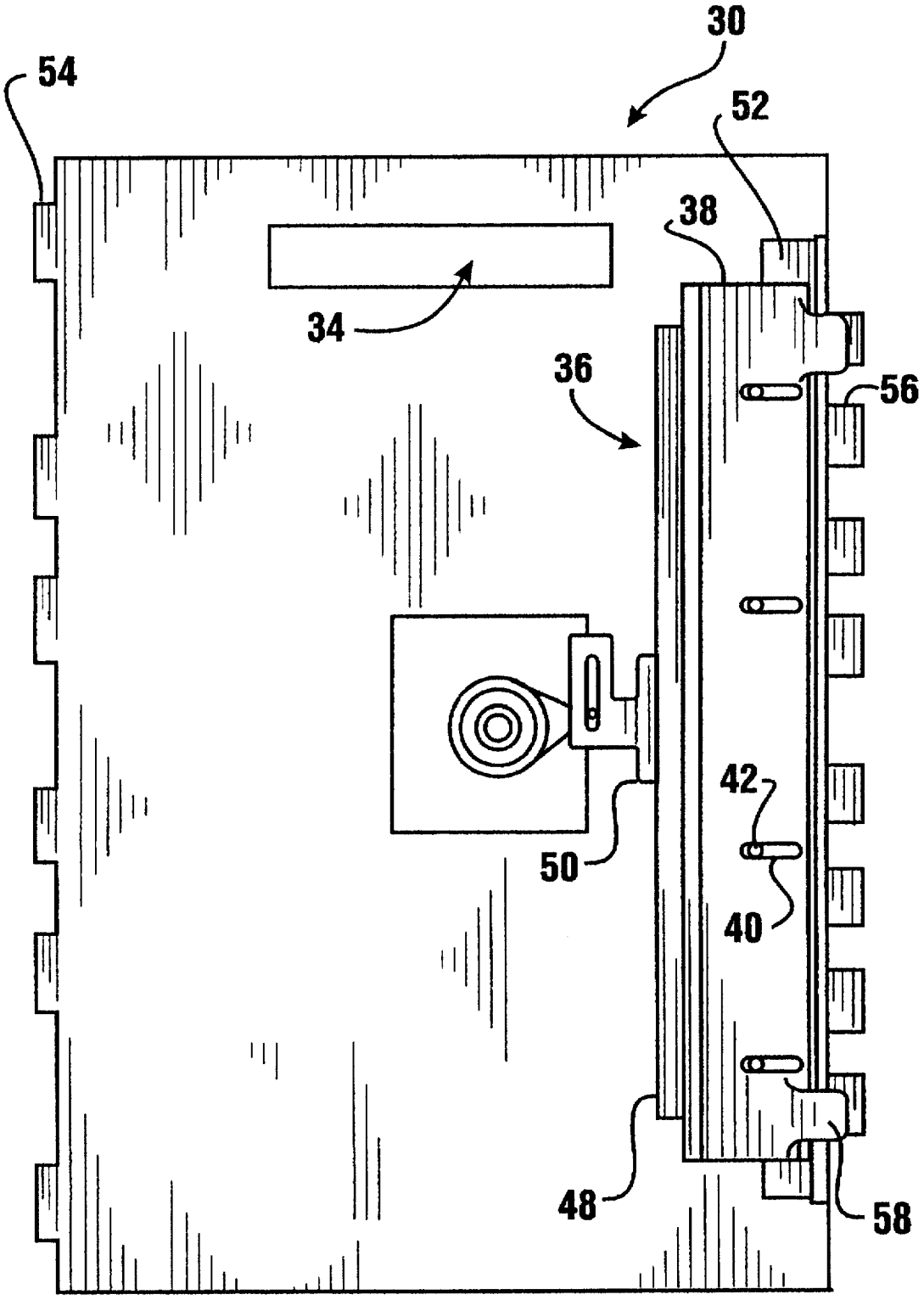
FIG. 3 is a plan interior view of a door and bolt work of the apparatus of the present invention.
Figure 4:
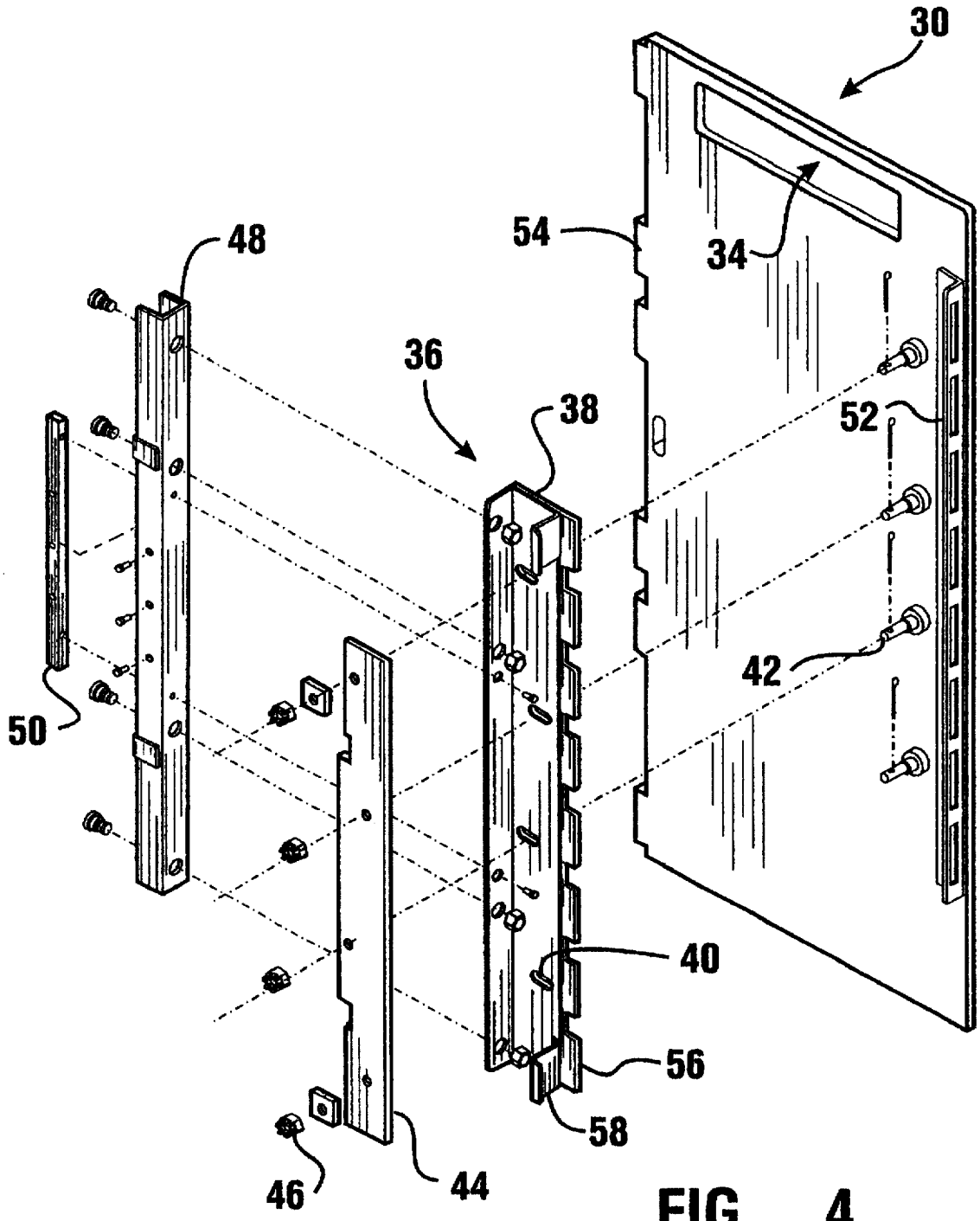
FIG. 4 is an exploded isometric view of the interior of the door and bolt work shown in FIG. 3.
Figure 5:
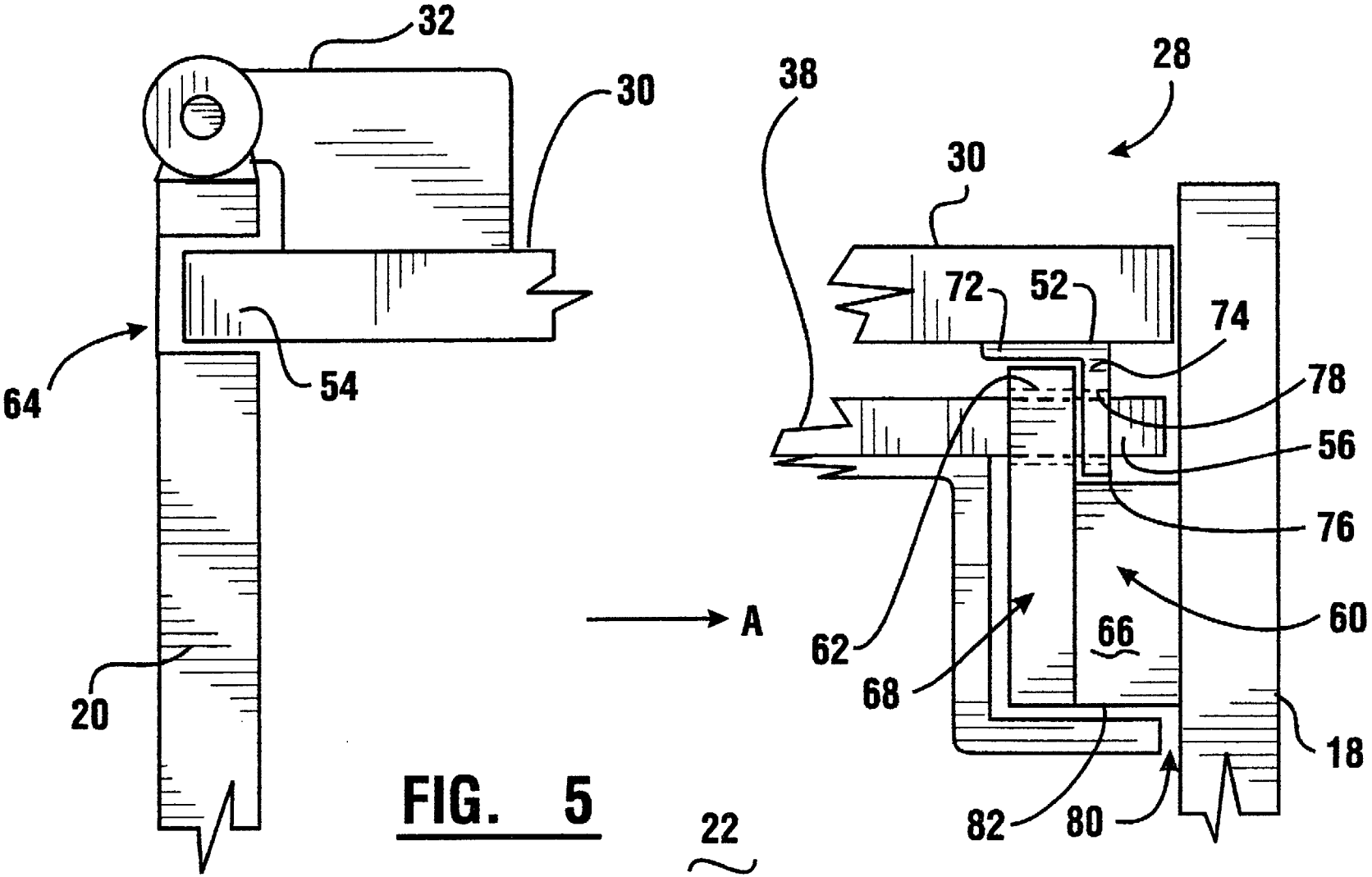
FIG. 5 is a cross-sectional view of an engaged bolt and latch and deadbolt of a first embodiment of the present invention in a secured condition.

Enclosure 10 includes an opening 28. A door 30 shown in FIGS. 3 and 4 is movably mounted on enclosure 10 to selectively open and close the opening. Door 30 is preferably a solid slab of heavy gage steel similar to the walls which make up the enclosure. Door 30 is movably mounted to second side wall 20 by hinges 32 as shown in FIG. 5. The hinges enable door 30 to be swung outward to provide access to the currency containers and transport housed in the interior area 22.

Door 30 further includes an opening 34 therethrough. In the closed position of the door, currency delivered by transport 26 is delivered through opening 34. Currency delivered through opening 34 is then taken by other transport mechanisms to a point of delivery. The point of delivery may be accessible to a bank teller or to a customer depending on the type of automated banking machine.

Door 30 has a bolt work generally indicated 36 mounted thereon. Bolt work 36 includes a bolt 38. Bolt 38 includes several horizontally elongated slots 40. A corresponding number of studs 42 extend inwardly from the inside face of door 30. Studs 42 extend through slots 40 and enable the bolt to be moved horizontally relative to the door. It should be noted that the horizontal slots are staggered so as to prevent cocking and binding of the bolt as it moves in supported relation on the studs.

The bolt is secured in engagement with the door by a retainer, schematically indicated 44, and a plurality of locking nuts 46 which are threaded on the ends of the studs 42. The locking nuts are secured in position with cotter pins as shown or other suitable securing means.

Bolt 38 is connected to a channel 48. Channel 48 is connected to an actuating bar 50. As schematically shown in FIG. 3, actuating bar 50 is operatively connected to a lock that is changeable by authorized personnel to control the secured condition of the door. The lock is in operative connection with a lever which is connected to the actuating bar which enables the bolt to be moved from the outwardly extended position to a retracted position when the lock is in the unlocked condition.

Many types of conventional locks and actuating lever mechanisms may be used in connection with the present invention. For example, a mechanism of the type shown in U.S. Pat. No. 4,690,073, the disclosure of which is incorporated by reference, may be used to ensure that the lock and lever used for moving the bolt cannot be easily compromised. The particular type of lock and lever used for moving the bolt will depend on the degree of security required and the configuration of the particular enclosure. The selection of such appropriate conventional locking mechanisms is within the knowledge of those skilled in the art.

As shown in FIGS. 3 and 4, door 30 further includes an angle member 52. Angle member 52 is fixably mounted to an interior face of the door. Door 30 further includes on a horizontal side opposed of angle member 52, a side wall portion including a plurality of projecting portions 54. The purpose of these projecting portions is later discussed in detail.

Bolt 38 includes a plurality of vertically spaced front portions 56. Bolt 38 also includes a pair of outward extending back portions 58. Back portions 58 are inwardly disposed in the enclosure from front portions 56 so as to make the bolt generally fork-shaped in cross section. It should be understood that while eight front portions and two back portions are shown in the embodiment depicted in FIGS. 3 and 4, in other embodiments of the invention other numbers of front and back portions may be used.

A latch 60 is mounted to first side wall 18. As shown in FIG. 2 latch 60 includes a plurality of latch apertures 62. Latch apertures 62 have contours that closely correspond to the profiles of front portions 56 but are sized for enabling a front portion to extend therein.

Second side wall 20 includes a plurality of pockets 64 which extend therethrough. The configuration of pockets 64 correspond closely to the configuration and position of projecting portions 54 on door 30. Some of the pockets 64 are positioned closely adjacent to the upper and lower corners of the enclosure on the second side wall. These corners are among the strongest areas of the enclosure due to the mating of the side wall with the top and bottom walls.

A cross-sectional view of the bolt and latch is shown in FIG. 5. FIG. 5 shows the bolt in the outwardly extended position as indicated by Arrow A. This represents the secure position of the bolt. Latch 60 is generally "L" shaped in cross section. It includes a base portion 66 which is secured to an interior surface of side wall 18. Latch 60 further includes a bolt engaging portion 68 through which the latch apertures 62 extend.

Bolt engaging portion 68 further includes a nose portion 70. Nose portion 70 abuttingly engages a leg 72 of angle member 52 when the door 30 is in the closed position as shown. Angle member 52 further includes a further leg 74. Leg 74 serves as a projecting member that extends intermediate bolt engaging portion 68 of the latch and first side wall 18. Leg 74 includes a bolt engaging portion 76 through which a plurality of projection apertures 78 extend. Projection apertures 78 each have a contour that closely conforms to front portions 56, but are each sized to enable a front portion to extend therein.

Latch 66 further includes second bolt engaging portions generally indicated 80. The second bolt engaging portions include an inward face 82. In the form of the invention shown in FIG. 5, inward face 82 is a generally planar face that extends parallel to the inside face of door 30.

In the extended position of the bolt shown in FIG. 5, each front portion 56 of the bolt extends in a latch aperture 62 in the latch. Each front portion also extends in a projection aperture 78 in the inward extending leg of angle member 52. As angle member 52 and bolt 38 are both secured to door 30, and latch 60 is secured to first side wall 18, such engagement prevents outward movement of door 30.

In the extended position of the bolt 38 shown in FIG. 5, back portions 58 of the bolt engage the second bolt engaging portions 80 by extending behind face 82. As a result, the engagement of back portions 58 further serves to prevent the outward movement of door 30. Further in the closed position of the door shown in FIG. 5, the abutting relation of nose portion 70 of the latch to the leg portion 72 of angle member 52 prevents inward movement of door 30. Likewise inward movement is prevented by the close abutting relation of leg 74 of the angle member and base portion 66 of latch 60. As a result, in the extended position of the bolt shown in FIG. 5, door 30 is effectively prevented from moving either outward or inward in the area adjacent first wall 18.

As also shown in FIG. 5, in the closed position of door 30, projecting portions 54 which are on a side of the door opposite to latch 60, extend in pockets 64 in second wall 20. In the preferred form of the invention the contour of the pockets conforms closely to the profiles of the projecting portions. As a result of this engagement, door 30 is prevented from being moved outward or inward. It should be noted that the prevention of movement of door 30 in this configuration is accomplished even if the hinges 32 are compromised by removal of the pins or other means.

Figure 6:
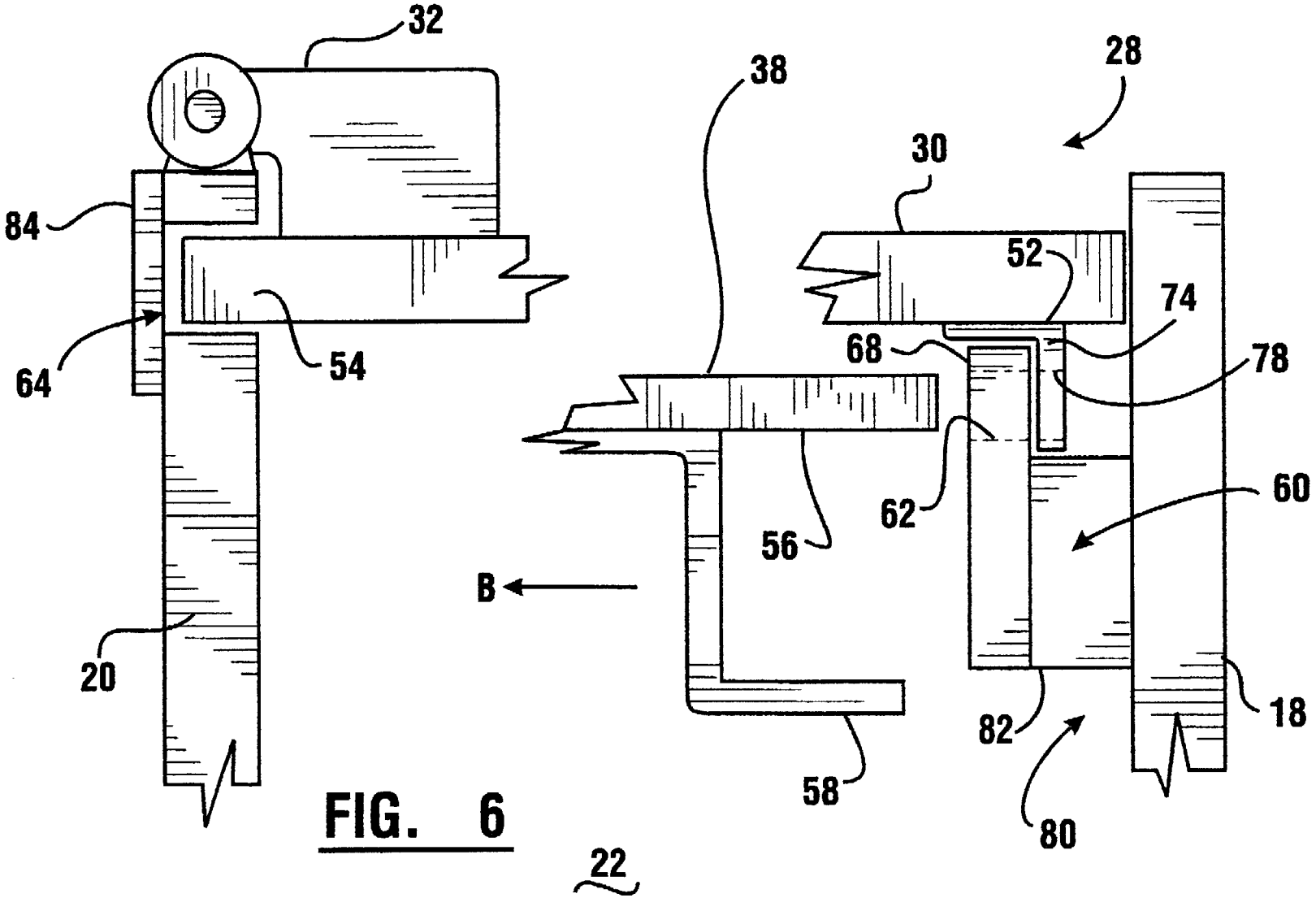
FIG. 6 is a cross-sectional view similar to FIG. 5 but with the bolt shown to an unsecured condition.

Movement of bolt 38 to a retracted position, in which position door 30 may be opened is shown in FIG. 6. To retract the bolt 38 it is moved in the direction of Arrow B. In this position, front portions 56 are disposed from latch apertures 62 in latch 60. Front portions 56 are also disposed out of the projection apertures 78 in angle member 52. In the retracted position of bolt 38, back portions 58 are disposed from the inward face 82 of second bolt engaging portions 80. In this position of the bolt, door 30 is enabled to be moved outward so as to provide access to the interior area of the enclosure through opening 28.

As door 30 is moved outward on the side adjacent the latch, projecting portions 54 rotate out of pockets 64. As a result, door 30 can be fully opened and authorized personnel can perform work on the apparatus in the interior area. When such work is completed, the door can be returned to the closed position wherein the projecting portions 54 again extend in the pockets. The bolt can then be thrown using a lever or other mechanism, back to the extended position shown in FIG. 5. The lock or locks on the door may then be resecured in the appropriate manner.

It should be mentioned that in a preferred form of the invention, the contours of the apertures 62 and 78 are made to conform closely to the profiles of front portions 56 of the bolt. As a result, when bolt 38 is in the extended position and a thief attempts to deform the door or first side wall 18 in an effort to gain access to the enclosure, such deformation will result in the front portions 56 becoming jammed. The jamming of front portions 56 in apertures 62 and 78 makes it much more difficult to retract the bolt and further holds door 30 in the closed position.

Security is further enhanced because first bolt engaging portion 68 of the latch is disposed inwardly from both the edge of the door and from leg 74 of angle member 52. Security is further enhanced because the door is recessed in the opening when the door is in the closed position. This construction makes it more difficult to access the latch or to deform the latch by using burglar tools extending through an opening created between the edge of door 30 and wall 18. The result is more secure closure of the door.

Engagement of projecting portions 54 in pockets 64 when the door is closed also enhances security of the enclosure and minimizes the risk that the door will be compromised. The fact that pockets 64 are located at disposed locations along side wall 20 further enhances security. Specifically the positioning of pockets and projections adjacent to the corners of side wall 20 provide a deadbolt that securely engages the door to some of the strongest areas of the enclosure.

To further enhance security, pockets 64 are preferably provided with a cover 84 as shown in FIG. 6. Cover 84 prevents access to the pockets 64 from the exterior of the enclosure. Cover 84 is preferably permanently secured to the walls of the enclosure such as by welding and is preferably covered with decorative trim. This construction further presents the advantage that pockets 64 may be accurately cut in wall 20 of the chest using cutting techniques such as laser cutting which provides a very accurate pocket contour. Likewise, projecting portions 54 are preferably precisely cut using a similar technique so that in the closed position, projections 54 and pockets 64 fit together in precise mating relation.

Figure 7:
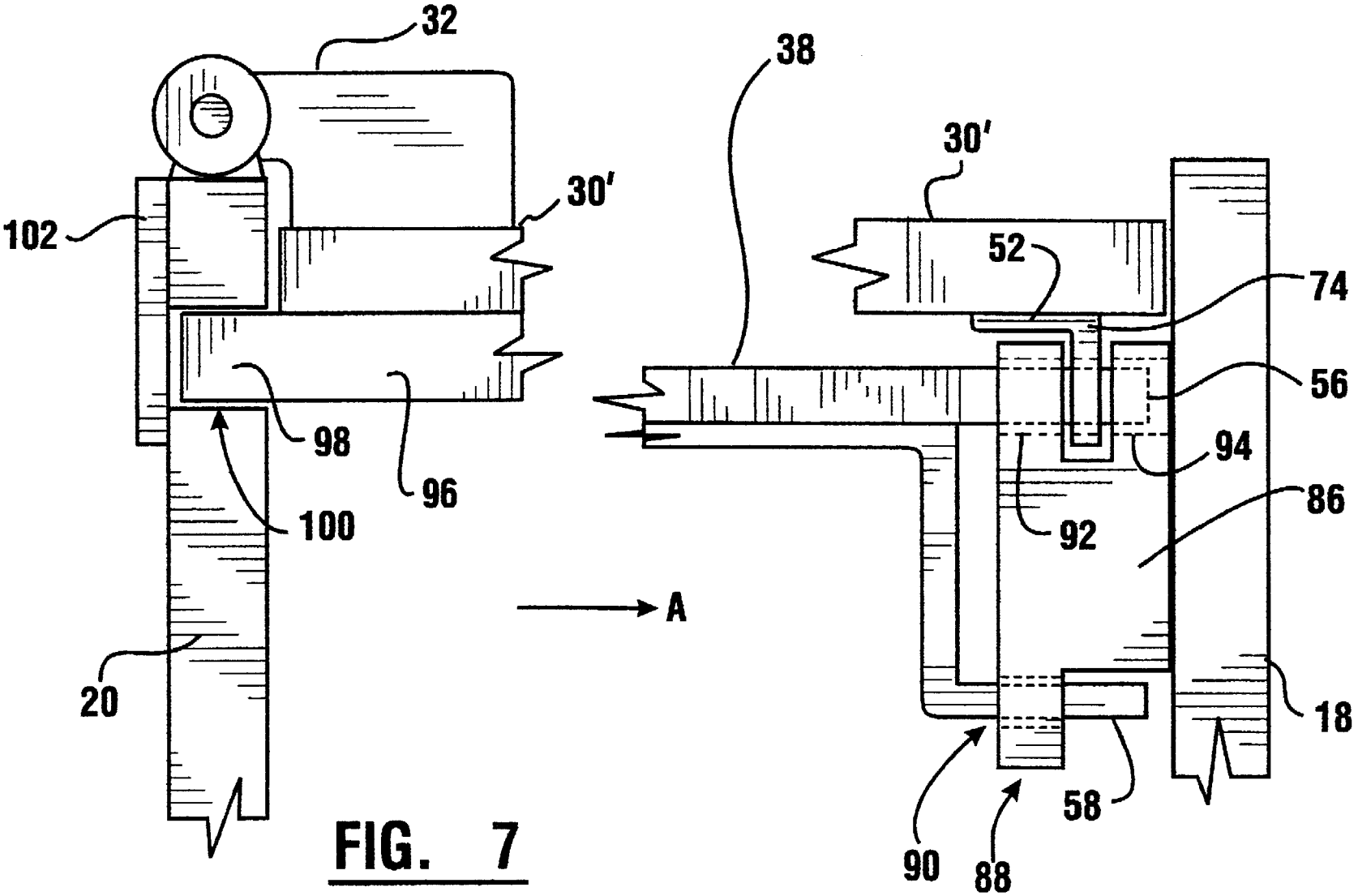
FIG. 7 is a cross-sectional view showing alternative embodiments of the latch and deadbolt of the present invention.

Alternative embodiments of the latch and deadbolt of the present invention are shown in FIG. 7. In these alternative embodiments, the components are the same as in the previously described embodiment except as expressly discussed herein.

Specifically, the embodiment shown in FIG. 7 includes an alternative latch 86. Latch 86 is similar to latch 60 except that it includes a second bolt engaging portion 88 which includes an aperture 90 therethrough. Aperture 90 accepts back portions 58 of bolt 38 therein when the bolt is in the extended position.

Latch 86 further includes a first front latch aperture 92 and a second front latch aperture 94. The first and second latch apertures bound a recess into which first leg 74 of angle member 52 is accepted. When the bolt 38 is in the extended position, each front portion 56 extends through bolt apertures 92 and 94 as well as an aperture in leg 74 of the angle member. This engagement in combination with back portions 58 extending through apertures 90 may provide enhanced resistance to attack by increasing the points at which the front and back portions of the bolt can be caused to jam in the latch as a result of deformation due to attack. In alternative embodiments of the invention the movable range of the bolt may be extended so that the bolt extends in apertures in the side wall when the bolt is in the extended position.

In the alternative embodiment of the invention shown in FIG. 7, a plate member 96 is attached in secured relation to the interior of the door 30. Plate member 96 includes projecting portions 98 which are accepted in pockets 100 in side wall 20 when the door is in the closed position. As shown in FIG. 7, access to pockets 100 is preferably prevented by a cover 102 which is secured to the exterior face of wall 20 by welding or another appropriate permanent method.

As demonstrated through the comparison of FIG. 7 to FIGS. 5 and 6, the positions of the projections and pockets may be varied. Such variations may include varying the size and vertical and/or horizontal positions of the pockets and projections on the door. This can be achieved by using a combination of projections on the door and projections on plates extending interiorly of the door. By varying the positions of the pockets it becomes more difficult for a thief to select a vulnerable point of attack. Further it may be advisable to vary the position of the projections and pockets from machine to machine. In addition, the size of cover 102 can be made sufficiently large and the cover may be overlaid with trim pieces so as to avoid giving any indication as to the position of the projections and engaging pockets when the outside of the enclosure is observed.

It should also be noted that although in the embodiments of the deadbolt construction shown the projecting portions are supported on the doors and the pockets are in the walls of the enclosures, this arrangement may be reversed. Specifically, embodiments of the invention may include projections that extend from an inner face of a wall into engagement with a pocket that is supported on the door. The positions of the projections and pockets may also be varied in both size and vertical and horizontal orientation to enhance security. Further, in embodiments of the present invention combinations of projecting portions and pockets on both the walls and door may be used. This enables the use of a unique physical combination for securing the door of the particular enclosure and makes it much more difficult for a thief who is unfamiliar with the interior of the particular enclosure to select points of attack.

The new bolt work and deadbolt construction for secure enclosures in an automated banking machine of the invention provides a reliable, yet economical means for securing a door of an enclosure in a closed position. The invention further provides a reliable means of keeping the door closed despite deformation due to attack on the door or enclosure by a thief attempting to gain access. Further, the present invention is readily adaptable to a variety of secure enclosure configurations, locking mechanisms and lever mechanisms for moving a bolt. This makes the present invention particularly well adapted for use on a variety of types of enclosures and banking devices.

Thus the new secure enclosure for an automated banking machine of the present invention achieves the above-stated objectives, eliminates difficulties encountered in the use of prior devices and systems, solves problems and attains the desirable results described herein.

In the foregoing description certain terms have been used for brevity, clarity and understanding. However, no unnecessary limitations are to be implied therefrom because such terms are for descriptive purposes and are intended to be broadly construed. Moreover the descriptions and illustrations given herein are by way of examples and the invention is not limited to the details shown and described.

In the following claims any feature described as a means for performing a function shall be construed as encompassing any means capable of performing the recited function and shall not be limited to the features shown in the foregoing description or mere equivalents.

Having described the features, discoveries and principles of the invention, the manner in which it is constructed and operated, and the advantages and useful results attained; the new and useful structures, devices, elements, arrangements, parts, combinations, systems, equipment, methods, operations and relationships are set forth in the appended claims.

We claim:

1. Apparatus for securing a door in a closed position in an opening of an enclosure, said opening bounded by a wall, and wherein said door is in operatively connected relation with a lock changeable between secured and unsecured conditions, said apparatus comprising:

a projecting member, said projecting member in supported relation with said door, wherein in cross section and in the closed position of said door said projecting member extends inwardly in said enclosure and is adjacent said wall;

a latch, said latch in supported connection with said wall inwardly of said opening, and wherein in cross section said latch comprises a first bolt engaging portion, wherein said first bolt engaging portion extends towards said opening, and wherein in the closed position of said door said projecting member extends between said first bolt engaging portion and said wall;

a bolt, said bolt in movably supported connection on one of either said door or said wall, wherein said bolt is movable when said lock is in the unsecured condition from an extended to a retracted position, wherein when the bolt is in the retracted position the bolt is disengaged from both the first bolt engaging portion of said latch and said projecting member, wherein the door is movable in a direction outward from the interior area to an open position, and wherein when said bolt is in the extended position said bolt is in engagement with said first bolt engaging portion of said latch and with said projecting member, wherein said door is held in the closed position.

2. The apparatus according to claim 1 wherein said first bolt engaging portion of said latch includes a first aperture and wherein said projecting member includes a second aperture, and wherein in the extended position said bolt extends in both said first and second apertures.

3. The apparatus according to claim 1 wherein said bolt is in movably supported connection with said door, and wherein in cross section in the extended position of said bolt said entire bolt is transversely disposed from said wall.

4. The apparatus according to claim 1 wherein said bolt is in movably supported connection with said door, and wherein said bolt comprises a front portion and a back portion, and wherein in cross section said back portion is disposed inwardly of said front portion, and wherein said latch further comprises a second bolt engaging portion, wherein in the extended position of said bolt, said back portion is in engagement with said second bolt engaging portion.

5. The apparatus according to claim 1 wherein said bolt comprises a plurality of front portions each disposed from one another, and wherein said first bolt engaging portion of said latch includes said plurality of first apertures, and wherein in the extended position of said bolt each front portion extends in one of said first apertures.

6. The apparatus according to claim 5 wherein said projecting member comprises said plurality of second apertures, and wherein in the extended position of said bolt each front portion extends in one first aperture and one second aperture.

7. The apparatus according to claim 6 wherein said projecting member in cross section comprises a first leg of an angle member, and wherein said angle member comprises a second leg, and wherein in the closed position of said door said first bolt engaging portion is in abutting relation of said second leg of said angle member.

8. The apparatus according to claim 5 wherein said bolt comprises more than one back portion and said latch comprises more than one of said second bolt engaging portions, wherein each back portion engages a second bolt engaging portion when said bolt is in the extended position.

9. The apparatus according to claim 4 wherein said latch comprises a base portion in connected relation with said wall, and wherein said first bolt engaging portion and said second bolt engaging portion are positioned on opposed sides of said base portion.

10. The apparatus according to claim 1 and further comprising a plurality of interengaging pockets and projecting portions adjacent an opposed side of said door generally opposed of said latch, and wherein one of either said pockets or projecting portions are in supported connection with said door, and said other of said pockets or projecting portions are in supported connection with a wall portion adjacent said opposed side of said door, and wherein in the closed position of said door said projecting portions extend in said pockets.

11. The apparatus according to claim 10 and further comprising at least one hinge, wherein said door is supported on said hinge at said opposed side, whereby said door is rotatable about said hinge, and wherein said projecting portions rotate into extending relation with said pockets as said door moves from an open position to the closed position.

12. The apparatus according to claim 10 wherein said enclosure comprises a generally rectangular enclosure in transverse cross section, and wherein said enclosure comprises at least one corner, and wherein at least one of said pockets extends in said wall portion adjacent said corner.

13. The apparatus according to claim 10 and wherein said pockets extend in said wall portion, and wherein said pockets are disposed at varying distances inwardly from said opening.

14. The apparatus according to claim 10 wherein said pockets and projecting portions are spaced from one another at irregular intervals.

15. The apparatus according to claim 1 wherein said bolt comprises a plurality of front portions each disposed from one another, and wherein said projecting member comprises a plurality of apertures, wherein in the extended position of said bolt, each front portion extends in one of said apertures.

16. The apparatus according to claim 2 wherein deformation of said wall supporting said latch moves said first aperture to jam said bolt in engaged extending relation therein.

17. The apparatus according to claim 2 wherein deformation of said door moves said second aperture to jam said bolt in engaged extending relation therein.

18. The apparatus according to claim 5 wherein each of said front portions has a profile in cross-section and wherein said first apertures each have a first contour in close conforming relation with said profile, wherein movement of said latch due to deformation of said wall jams said first portions in extending relation in said first apertures.

19. The apparatus according to claim 18 wherein said projecting member comprises a plurality of second apertures and wherein said second apertures each have a second contour in closely conforming relation with said profile, and wherein in the extended position of said bolt, each front portion extends in one first aperture and one second aperture, and wherein deformation of said door or of said wall moves at least one of said latch or said projecting member to jam said aperture therein in the extending position.

20. The apparatus according to claim 1 wherein said door is recessed inwardly from an outer face of said wall in the closed position, and wherein said latch is in operatively supported connection with said wall at a location disposed inwardly from an inner face of said door, whereby access to said latch by a tool forced between said door and said wall is minimized.

21. An apparatus for securing a door in a closed position closing an opening to an interior area of an enclosure, wherein said enclosure includes a wall bounding said interior area, and wherein said door is movable in an outward direction to open said opening, and wherein said door is in connected relation with a lock, wherein said lock is changeable between locked and unlocked conditions, said apparatus comprising:

a bolt, wherein said bolt is movably mounted in supported relation with said door, wherein said bolt is movable from an extended position to a retracted position responsive to the unlocked condition of said lock, and wherein in cross section said bolt comprises a front portion and a back portion;

a latch in said interior area, wherein said latch is in operatively secured relation with said wall, and wherein said latch includes in cross section a first bolt engaging portion, wherein said first bolt engaging portion is disposed from said wall and adjacent said opening, and wherein in the closed position of said door and in the extended position of said bolt said front portion is in engagement with said first bolt engaging portion, whereby said engagement of said front portion prevents movement of said door in said outward direction; and wherein said latch further comprises in cross section a second bolt engaging portion, wherein said second bolt engaging portion is disposed from said wall and is disposed inward in said enclosure from said first bolt engaging portion, and wherein in the closed position of said door and in the extended position of said bolt said back portion is in engagement with said second bolt engaging portion, whereby said engagement of said back portion prevents movement of said door in said outward direction.

22. The apparatus according to claim 21 wherein said first bolt engaging portion of said latch includes a first latch aperture, and wherein in said extended position of said bolt said front portion extends through said first latch aperture.

23. The apparatus according to claim 22 wherein said front portion of said bolt in cross section has a profile, and wherein said first latch aperture in cross section has a latch aperture contour in closely conforming relation to said profile, whereby deformation of said door or said latch jams said bolt in engagement with said latch.

24. The apparatus according to claim 21 and further comprising a projecting member, wherein said projecting member is in operatively secured relation with said door, and wherein in the closed position of said door, said projecting member in cross section extends intermediate of said first bolt engaging portion and said wall, and wherein said projecting member includes a third bolt engaging portion, and wherein in the extended position of said bolt, said front portion engages said third bolt engaging portion, whereby said engagement prevents movement of said door in the outward direction.

25. The apparatus according to claim 24 wherein said projecting member includes a first projection aperture, and wherein in the extended position of said bolt said front portion extends in said first projection aperture.

26. The apparatus according to claim 25 wherein said front portion of said bolt in cross section has a profile, and wherein said first projection aperture in cross section has a projection aperture contour in closely conforming relation to said profile, whereby deformation of said door or said bolt jams said bolt in engagement with said projecting member.

27. The apparatus according to claim 24 wherein said first bolt engaging portion includes a first latch aperture, and wherein said third bolt engaging portion includes a first projection aperture, and wherein in the extended position of said bolt said front portion extends in both said first latch aperture and said first projection aperture.

28. The apparatus according to claim 27 wherein said front portion of said bolt in cross section has a profile and wherein said first latch aperture and said first projection aperture in cross section have a first aperture contour and a second aperture contour respectively, and wherein said first and second aperture contours closely conform with said profile, whereby deformation of said wall or said door jams said bolt in the extended position.

29. The apparatus according to claim 24 and further comprising an angle member in operatively secured engagement with said door, and wherein in cross section said angle member has a first leg including said projecting member, and wherein said angle member has a transversely extending second leg, and wherein said first bolt engaging portion of said latch includes a nose portion, and wherein in the closed position of said door said nose portion is in abutting relation of said second leg of said angle member.

30. The apparatus according to claim 21 wherein said second bolt engaging portion includes an inward face of said latch.

31. The apparatus according to claim 21 wherein said bolt is generally fork shaped in cross section.

32. The apparatus according to claim 21 wherein said latch is generally L-shaped in cross section.

33. The apparatus according to claim 32 wherein said latch comprises in cross section a base portion extending in said enclosure inwardly from said wall, and wherein said first bolt engaging portion extends outwardly toward said opening from said base portion.

34. The apparatus according to claim 33 wherein said second bolt engaging portion includes an inward face of said base portion, said inward face extending on a side of said base portion opposed of said first engaging portion.

35. The apparatus according to claim 21 wherein said bolt comprises a plurality of front portions disposed from each other in a longitudinal direction, and wherein said first bolt engaging portion engages said plurality of front portions in said plurality of longitudinally disposed locations.

36. The apparatus according to claim 21 wherein said bolt comprises a plurality of front portions disposed from each other in a longitudinal direction, and wherein said first bolt engaging portion includes a plurality of first latch apertures, wherein each front portion of said bolt extends in one of said latch apertures when said bolt is in the extended position.

37. The apparatus according to claim 36 and further comprising in cross section a projecting member in operatively secured relation with said door, wherein said projecting member extends intermediate of said first bolt engaging portion and said wall when said door is in the closed position, and wherein said projecting member comprises said plurality of first projection apertures, and wherein in the extended position of said bolt each front portion extends in one of said first projection apertures.

38. The apparatus according to claim 21 wherein said bolt comprises a second plurality of said back portions disposed in a longitudinal direction from one another, and wherein said latch comprises said second plurality of second bolt engaging portions, and wherein said latch engages said back portions in said second plurality of longitudinally disposed locations.

39. The apparatus according to claim 21 wherein said latch is securely engaged with a first wall portion, and wherein said enclosure includes a second wall portion bounding said enclosure on a side generally opposed of said first wall portion, and wherein said second wall portion comprises a pocket inwardly disposed of said opening, and further comprising a projecting portion in operatively secured connection with said door, and wherein said projecting portion extends in said pocket when said door is in the closed position, whereby said engagement of said pocket and said projecting portion prevents movement of said door in an outward direction.

40. The apparatus according to claim 39 wherein said second wall portion is in supporting relation with a hinge, and wherein said hinge is in connected relation with said door, and wherein said projecting portions are positioned inwardly of said hinge.

41. The apparatus according to claim 39 wherein said second wall portion comprises a plurality of pockets, and wherein said door is in operatively secured connection with said plurality of projecting portions, and wherein each said projecting portion extends in a pocket when said door is in the closed position.

42. The apparatus according to claim 39 wherein said enclosure is a generally rectangularly enclosure, and wherein said second wall portion is a generally planar wall extending between a first corner and a second corner of said enclosure, and wherein said second wall portion includes a first corner pocket adjacent said first corner and a second corner pocket adjacent said second corner, and wherein said door is in operatively secured connection with a first projecting portion and a second projecting portion, wherein said first projecting portion extends in said first corner pocket and said second projecting portion extends in said second corner pocket when the door is in the closed position.

43. The apparatus according to claim 41 wherein said door includes a side portion, said side portion adjacent said second wall portion in the closed position of said door, and wherein said projecting portions extend on said side portion.

44. The apparatus according to claim 41 and further comprising a plate member in secured engagement with said door and wherein said plate member is disposed inwardly of said door when said door is in the closed position, and wherein said projecting portions extend on said plate member.

45. The apparatus according to claim 41 wherein said pockets extend through said second wall portion.

46. The apparatus according to claim 45 and further comprising a cover on an external face of said second wall portion and wherein said pockets are non-linearly arranged in said second side wall portion, and wherein said cover overlies all of said pockets.

47. An apparatus for securing a door in a closed position in an opening of an enclosure, said opening bounded by a wall, said door in operative connection with a lock changeable between secured and unsecured conditions, said apparatus comprising:

a bolt in supported connection with said door and a latch in supported connection with said wall, said bolt engaging said latch in an interior area of said enclosure in an extended position of said bolt, wherein said bolt engages said latch at a plurality of discrete, noncontiguous locations, and further comprising further engaging means in supported connection with said door for engaging said bolt in the extended position in said interior area, whereby said bolt is engageable with both said latch and said further engaging means, and wherein said bolt is movable from the extended position to a retracted position responsive to said lock being changed to the unsecured condition, and wherein in the retracted position of said bolt said bolt is disengaged from both said latch and said further engaging means, wherein said door is movable in an outward direction away from said interior area to an open position, wherein in said open position said bolt is outside said interior area.

48. The apparatus according to claim 47 wherein said locations wherein said bolt engages said latch include more than one first location on a first side of said latch adjacent said opening and more than one second location on a second side of said latch inwardly disposed of said first side.

49. The apparatus according to claim 47 wherein said locations include apertures and wherein in the extended position of said bolt, said bolt extends through said apertures to engage said further engaging means.

50. The apparatus according to claim 47 wherein said locations, said further engaging means and said bolt are disposed transversely inwardly of said wall when said bolt is in the extended position.

51. The apparatus according to claim 47 and further comprising projecting means and pocket means for accepting said projecting means in extending relation therein, said projecting means in supported relation of said door and extending in a direction opposed of said bolt in the extended position, said pocket means in supported connection with said wall and wherein said projecting means extend in said pocket means when said door is in the closed position.

52. Apparatus for securing a door in an opening of an enclosure, said opening bounded by a wall, said door including a lock changeable between secured and unsecured conditions, comprising:

a bolt movable responsive to the condition of the lock, the bolt being supported on said door and having a plurality of discrete, noncontiguous front portions;

a latch in supported connection with said wall, said latch including a plurality of first bolt engaging portions disposed both inwardly from said opening and away from said wall in the interior area;

a projecting member in supported connection with said door, said projecting member including a plurality of second engaging portions, said second engaging portions disposed between said first bolt engaging portions of said latch and said wall in a closed position wherein said door closes said opening, and wherein in the unsecured condition of said lock said door is movable in an outward direction from said opening, said outward direction being generally away from said interior area;

wherein said door is secured in said opening by a process comprising the steps of: moving said door toward the interior area to the closed position; engaging each of said front portions of said bolt with one of said plurality of first bolt engaging portions of said latch, and further engaging each of said front portions of said bolt with one of said plurality of second bolt engaging portions of said projecting member, whereby said door is held in the closed position.

53. The apparatus according to claim 52 wherein said bolt is enabled to disengage each of said first bolt engaging portions of said latch and said second bolt engaging portions of said projecting member responsive to the unsecured condition of said lock.

54. The apparatus according to claim 52 and further comprising at least one back portion on said bolt, and at least one back bolt engaging portion on said latch, wherein said back bolt engaging portion is disposed inwardly of said first bolt engaging portions; and wherein said securing process further comprises the step of engaging said back portion of said bolt with said back bolt engaging portion of said latch.

55. The apparatus according to claim 52 wherein said first bolt engaging portion comprises a second plurality of first apertures and said projecting member comprises said second plurality of second apertures, and wherein said engaging step comprises extending each of said front portions of said bolt into a first aperture and wherein said further engaging step comprises extending each of said front portions of said into a second aperture.

56. Apparatus for securing a door in a closed position in an opening of an enclosure, said opening bounded by a wall, and wherein said door is in operatively connected relation with a lock changeable between secured and unsecured conditions, said apparatus comprising:

a projecting member, said projecting member in supported relation with said door, wherein in cross section and in the closed position of said door said projecting member extends inwardly in said enclosure and is adjacent said wall;

a latch, said latch in supported connection with said wall, wherein said connection of said latch and said wall is limited to an area disposed inwardly and away from said opening, and wherein in cross section said latch comprises a first bolt engaging portion, wherein said first bolt engaging portion extends away from said area and towards said opening, and wherein in the closed position of said door said projecting member extends between said first engaging portion and said wall;

a bolt, said bolt in movably supported connection on one of said door or said wall, wherein said bolt is movable when said lock is in the unsecured condition from an extended to a retracted position, and wherein when said bolt is in the extended position said bolt is in operative engagement with both said first bolt engaging portion of said latch and with said projecting member, and wherein in said extended position of said bolt said latch and said projecting member are held generally immovable relative to one another by the operative engagement of each with the bolt, whereby said door is held in the closed position.

57. An apparatus for securing a door in a closed position closing an opening to an interior area of an enclosure, wherein said enclosure includes a wall bounding said interior area, and wherein said door is movable in an outward direction to open said opening, and wherein said door is in connected relation with a lock, wherein said lock is changeable between locked and unlocked conditions, said apparatus comprising:

a bolt, wherein said bolt is movably mounted in supported relation with said door, wherein said bolt is movable from an extended position to a retracted position responsive to the unlocked condition of said lock, and wherein in cross section said bolt comprises a front member and a back member, and wherein in the closed position of the door the back member is disposed in an inward direction from both said opening and said front member;

a latch in said interior area, wherein said latch is in operatively secured relation with said wall, and wherein said latch includes in cross section a first bolt engaging member, wherein said first bolt engaging member is disposed away from said wall and adjacent said opening, and wherein in the closed position of said door and in the extended position of said bolt said front member is in engagement with said first bolt engaging portion, wherein said engagement of said front member prevents movement of said door in said outward direction;

wherein said latch further comprises in cross section a second bolt engaging member, wherein said second bolt engaging member is disposed from said wall and is disposed in the inward direction from said first bolt engaging member, and wherein in the closed position of said door and in the extended position of said bolt said back member is in engagement with said second bolt engaging member, wherein said engagement of said back member prevents movement of said door in said outward direction; and wherein in the retracted position of said bolt, said bolt is disengaged from said latch and said door is enabled to be moved in the outward direction from said opening.

* * * * *